US009178262B2

(12) United States Patent
Bishop et al.

(10) Patent No.: US 9,178,262 B2
(45) Date of Patent: Nov. 3, 2015

(54) FEED NETWORK COMPRISED OF MARCHAND BALUNS AND COUPLED LINE QUADRATURE HYBRIDS

(71) Applicants: Bruce Foster Bishop, Aptos, CA (US); Kathleen Fasenfest, Union City, CA (US)

(72) Inventors: Bruce Foster Bishop, Aptos, CA (US); Kathleen Fasenfest, Union City, CA (US)

(73) Assignee: Tyce Electronics Corporation, Berwyn, PA (US)

( * ) Notice: Subject to any disclaimer, the term of this patent is extended or adjusted under 35 U.S.C. 154(b) by 194 days.

(21) Appl. No.: 13/840,355

(22) Filed: Mar. 15, 2013

(65) Prior Publication Data

US 2014/0197901 A1 Jul. 17, 2014

Related U.S. Application Data

(60) Provisional application No. 61/752,931, filed on Jan. 15, 2013.

(51) Int. Cl.
*H01P 5/18* (2006.01)
*H01P 5/12* (2006.01)
*H01P 5/10* (2006.01)

(52) U.S. Cl.
CPC ... *H01P 5/12* (2013.01); *H01P 5/10* (2013.01)

(58) Field of Classification Search
CPC ..... H01P 5/16; H01P 5/18; H01P 5/184; H01P 5/187; H01P 5/10; H01P 3/082; H01P 3/084; H01P 3/088
USPC ..... 333/117, 26
See application file for complete search history.

(56) References Cited

U.S. PATENT DOCUMENTS

| | | | | |
|---|---|---|---|---|
| 3,423,688 | A * | 1/1969 | Seidel | 330/53 |
| 3,641,578 | A * | 2/1972 | Spanos et al. | 343/773 |
| 4,375,054 | A | 2/1983 | Pavio | |
| 5,572,172 | A | 11/1996 | Standke et al. | |
| 6,946,927 | B2 * | 9/2005 | Allen et al. | 333/116 |
| 2009/0309672 | A1 | 12/2009 | Yeung et al. | |
| 2010/0315175 | A1 * | 12/2010 | Ono et al. | 333/26 |

FOREIGN PATENT DOCUMENTS

| | | | |
|---|---|---|---|
| EP | 1703582 | A1 | 9/2006 |
| JP | 2012-114624 | A | 6/2012 |
| WO | WO-2009/077791 | A1 | 6/2009 |

OTHER PUBLICATIONS

Lo, W-K and Luk, K-M, "Bandwidth Enhancement of Circularly Polarized Microstrip Patch Antenna Using Multiple L-Shaped Probe Feeds", Microwave and Optical Technology Letters, vol. 42, No. 4, Aug. 20, 2004, pp. 263-265.

* cited by examiner

*Primary Examiner* — Benny Lee

(57) ABSTRACT

A feed network includes three radio frequency (RF) devices constructed in a suspended-substrate stripline configuration that provides a five-port microwave device having a sum port and four feed ports. The three RF devices include at least one coupled-line quadrature hybrid and at least one Marchand balun. Each of the at least one coupled-line quadrature hybrid has only a single transmission line section providing two outputs with approximately equal amplitude power and a phase difference of 90°. Each of the at least one Marchand balun includes two offset-coupled transmission line sections separated by a gap and two outputs on opposite sides of the gap. The two outputs have approximately equal amplitude power and a phase difference of 180°. The three RF devices are electrically arranged relative to the sum port and the four feed ports such that the feed ports have equal amplitude power and a progressive 90° phase shift.

20 Claims, 6 Drawing Sheets

FEED NETWORK COMPRISED OF MARCHAND BALUNS AND COUPLED LINE QUADRATURE HYBRIDS

CROSS-REFERENCE TO RELATED APPLICATIONS

This application claims priority from provisional Application No. 61/752,931, filed Jan. 15, 2013, the disclosure of which is incorporated herein by reference.

BACKGROUND OF THE INVENTION

The subject matter disclosed herein relates generally to transmission line circuitry, and more particularly to feed networks for antennas.

Various types of feed networks are used to feed radio frequency (RF) energy between one or more antennas and associated processing systems, such as transmitters, receivers, and/or transceivers. For example, a feed network may convert RF waves received by an antenna into RF electrical signals and deliver the RF electrical signals to the processing system, and/or vice versa. Known feed networks may include one or more various components for controlling the amplitude and phase of RF power at the antenna(s), and may include RF devices such as baluns, hybrid couplers, delay lines, phase shifters, and/or the like.

Known feed networks are not without disadvantages. For example, a plurality of antennas are often grouped together in an array. Each antenna typically includes a dedicated feed network that serves that particular antenna. Accordingly, the antenna array typically includes a plurality of antenna and feed network pairs. But, there may be a limited amount of space for containing the antenna and feed network pairs, which may limit the minimum spacing between antennas in an array. For example, the length, width, and/or a similar dimension (e.g., a diameter and/or the like) of at least some known feed networks may limit the minimum spacing between antennas in an array. Electronically-steerable antenna arrays exhibit grating lobes in at least some angular regions for antenna element spacings greater than one-half of a wavelength at the frequency of operation. Thus, the minimum spacing between antenna elements can determine the maximum operating frequency of an antenna array.

Another disadvantage of at least some known feed networks is bandwidth. Specifically, the operational frequency band of at least some known feed networks may be too narrow to enable the associated antenna to communicate with one or more devices.

Another disadvantage of at least some known feed networks is fabrication cost. Specifically, at least some known feed networks require manual assembly, lumped-element RF devices, and/or a high layer count (e.g., greater than four) printed circuit(s) with single or multiple lamination cycles.

BRIEF SUMMARY OF THE INVENTION

In one embodiment, a feed network includes three radio frequency (RF) devices constructed in a suspended-substrate stripline configuration that provides a five-port microwave device having a sum port and four feed ports. The three RF devices include at least one coupled-line quadrature hybrid and at least one Marchand balun. Each of the at least one coupled-line quadrature hybrid has only a single transmission line section providing two outputs with approximately equal amplitude power and a phase difference of 90°. Each of the at least one Marchand balun includes two offset-coupled transmission line sections separated by a gap and two outputs on opposite sides of the gap. The two outputs have approximately equal amplitude power and a phase difference of 180°. The three RF devices are electrically arranged relative to the sum port and the four feed ports such that the feed ports have equal amplitude power and a progressive 90° phase shift.

In another embodiment, a feed network includes three radio frequency (RF) devices constructed in a suspended-substrate stripline configuration that provides a five-port microwave device having a sum port and four feed ports. The three RF devices include first and second coupled-line quadrature hybrids each having only a single transmission line section that provides two outputs with approximately equal amplitude power and a phase difference of 90°. The three RF devices also include a Marchand balun having two offset-coupled transmission line sections separated by a gap and two outputs on opposite sides of the gap. The two outputs have approximately equal amplitude power and a phase difference of 180°. The Marchand balun and the first and second coupled-line quadrature hybrids are electrically arranged relative to the sum port and the four feed ports such that the feed ports have equal amplitude power and a progressive 90° phase shift.

In another embodiment, a feed network includes three radio frequency (RF) devices constructed in a suspended-substrate stripline configuration that provides a five-port microwave device having a sum port and four feed ports. The three RF devices include first and second Marchand baluns each having two offset-coupled transmission line sections separated by a gap and two outputs on opposite sides of the gap. The two outputs have approximately equal amplitude power and a phase difference of 180°. The three RF devices also include a coupled-line quadrature hybrids having only a single transmission line section that provides two outputs with approximately equal amplitude power and a phase difference of 90°. The coupled-line quadrature hybrid and the first and second Marchand baluns are electrically arranged relative to the sum port and the four feed ports such that the feed ports have equal amplitude power and a progressive 90° phase shift.

DETAILED DESCRIPTION OF THE INVENTION

Figure 1:
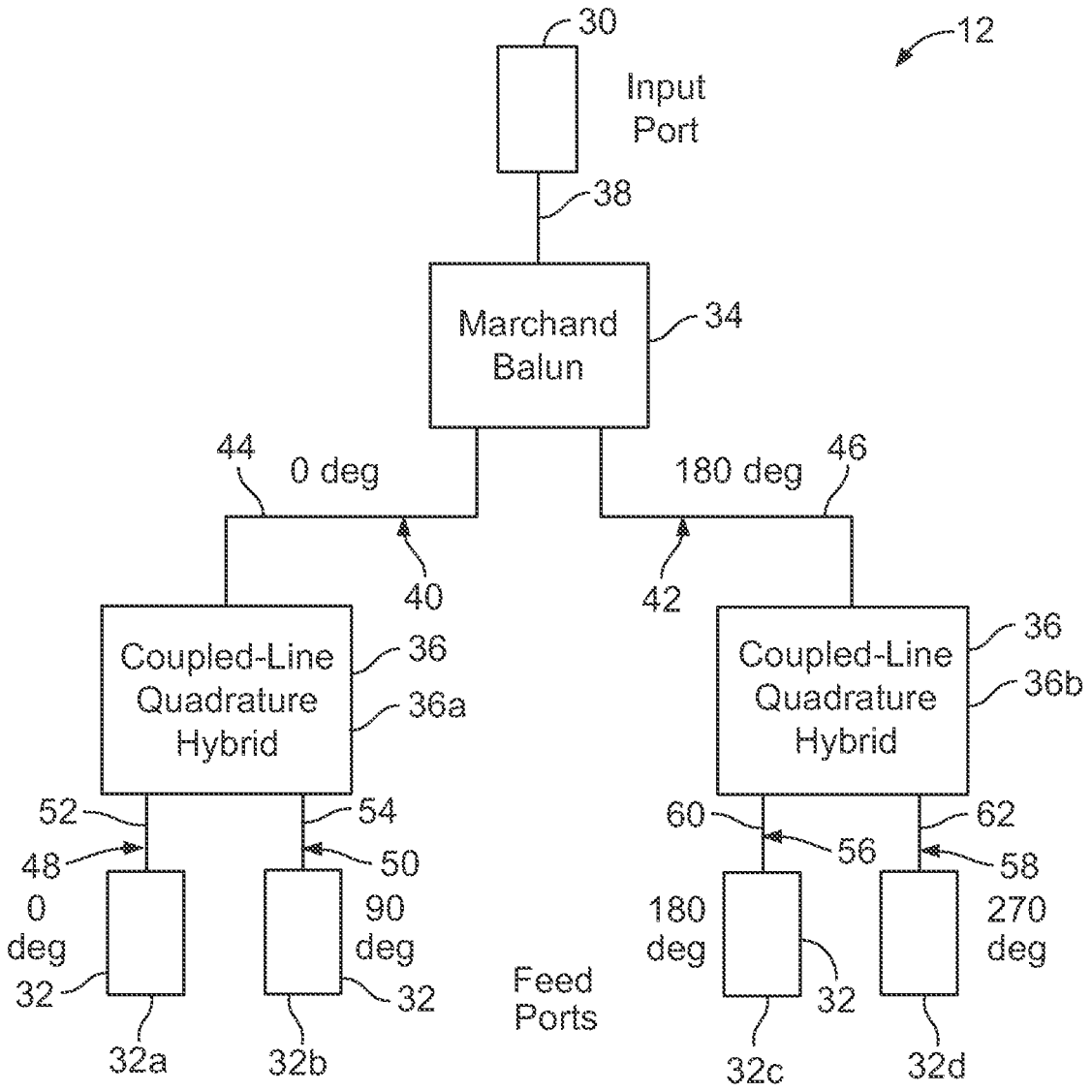
FIG. 1 is a schematic block diagram of an exemplary embodiment of a feed network.
Figure 3:
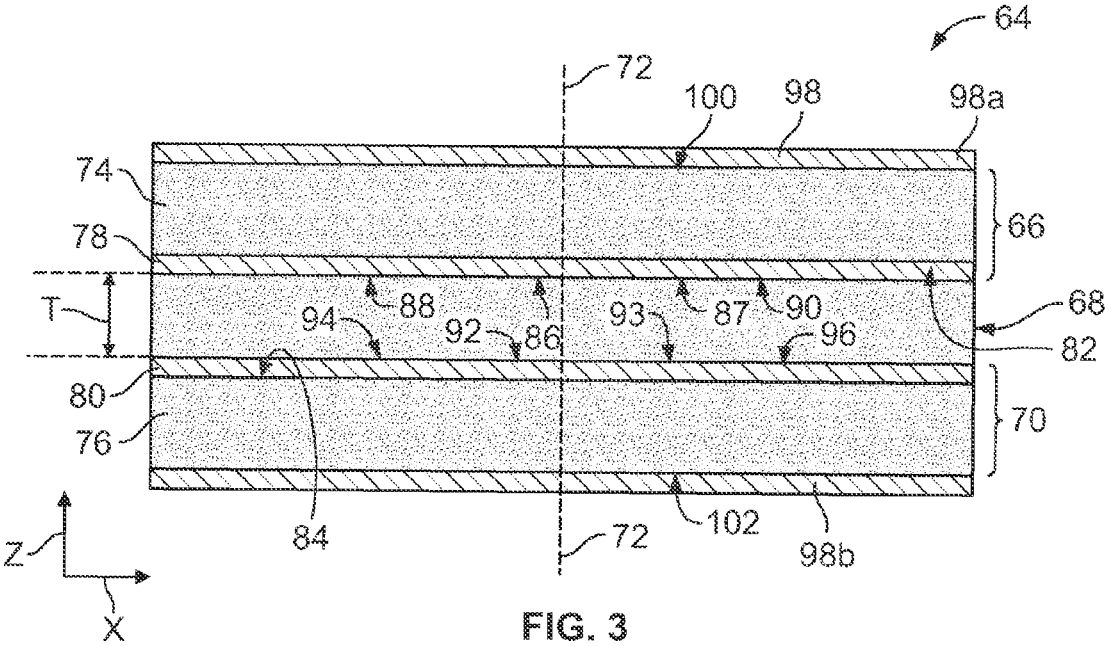
FIG. 3 is a cross-sectional view of the printed circuit shown in FIG. 2.

FIG. 1 is a schematic block diagram of an exemplary embodiment of a feed network 12. The feed network 12 may have a wide variety of applications, such as, but not limited to, driving one or more antennas, use with microwave circuits, and/or the like. The feed network 12 includes at least three radio frequency (RF) devices constructed in a suspended-substrate stripline configuration. As used herein, a "suspended-substrate stripline configuration" is intended to mean a multi-layered printed circuit stackup having an upper substrate core that provides two conductive layers, a lower substrate core that provides another two conductive layers, and one or more dielectric bonding layers that provide physical separation between the upper and lower substrate cores. An exemplary suspended-substrate stripline configuration is shown in FIG. 3. In the exemplary embodiment of the feed network 12, the feed network 12 includes an input port 30, four feed ports 32, a Marchand balun 34, and two coupled-line quadrature hybrids 36. Accordingly, in the exemplary embodiment of the feed network 12, the three RF devices include only a single Marchand balun 34 and two coupled-line quadrature hybrids 36. The four exemplary feed ports 32 are labeled as feed ports 32*a*, 32*b*, 32*c*, and 32*d*, while the two coupled-line quadrature hybrids 36 are labeled as coupled-line quadrature hybrids 36*a* and 36*b*. The input port 30 may be referred to herein as a "sum port". The Marchand balun 34 may be referred to herein as a "first" balun. The coupled-line quadrature hybrids 36*a* and 36*b* may each be referred to herein as a "first" and/or a "second" quadrature hybrid. Each of the feed ports 32 may be referred to herein as a "first", a "second", a "third", and/or a "fourth" feed port.

The Marchand balun 34 and the coupled-line quadrature hybrids 36 are operatively connected between the input port 30 and the feed ports 32 for feeding RF energy between the input port 30 and the feed ports 32. The Marchand balun 34 of the feed network 12 is configured to divide an RF signal into two RF signals that have approximately equal power amplitudes and are separated by a phase difference of 180°. Each of the coupled-line quadrature hybrids 36 is configured to divide an RF signal into two RF signals that have approximately equal power amplitudes with a phase difference of 90°. For purposes of the present disclosure, the term "RF" is used broadly to include a wide range of electromagnetic transmission frequencies including, for instance, those falling within the radio frequency, microwave or millimeter wave frequency ranges.

The Marchand balun 34 and the coupled-line quadrature hybrids 36 are electrically arranged relative to the input port 30 and the feed ports 32 such that the four feed ports 32 have approximately equal amplitude power and a progressive 90° phase shift. For example, in the exemplary embodiment of the feed network 12, the Marchand balun 34 is electrically connected between the input port 30 and the coupled-line quadrature hybrids 36, while the coupled-line quadrature hybrids 36 are electrically connected between the Marchand balun 34 and the feed ports 32. Specifically, and as shown in FIG. 1, the Marchand balun 34 is electrically connected between the input port 30 and each of the coupled-line quadrature hybrids 36*a* and 36*b*. The coupled-line quadrature hybrid 36*a* is electrically connected between the Marchand balun 34 and the feed ports 32*a* and 32*b*. The coupled-line quadrature hybrid 36*b* is electrically connected between the Marchand balun 34 and the feed ports 32*c* and 32*d*.

During operation of the feed network 12, the Marchand balun 34 receives an input RF signal 38 from the input port 30. The Marchand balun 34 divides the input RF signal 38 into two intermediate RF signals 40 and 42 that have approximately equal power amplitudes and are separated by a phase difference of 180°. The intermediate RF signals 40 and 42 have respective phases of 0° and 180°, relative to the phase of input RF signal 38. The feed network 12 includes circuit elements 44 and 46 where the Marchand balun 34 outputs the intermediate RF signals 40 and 42, respectively. The intermediate RF signal 40 may be referred to herein as a "first" intermediate RF signal, while the intermediate RF signal 42 may be referred to herein as a "second" intermediate RF signal. As described in more detail below in connection with FIGS. 4*a*-4*e*, "circuit elements" may be conductive lines, traces, segments, and/or the like formed as part of various layers of a printed circuit. The circuit elements 44 and 46 may each be referred to herein as an "output".

The coupled-line quadrature hybrid 36*a* is electrically connected to the circuit element 44 for receiving the intermediate RF signal 40 from the Marchand balun 34. The coupled-line quadrature hybrid 36*a* divides the intermediate RF signal 40 into two feed RF signals 48 and 50 that have approximately equal amplitudes and are separated by a phase difference of 90°. Specifically, the feed RF signals 48 and 50 have phases of 0° and 90°, respectively. The feed port 32*a* is electrically connected to a circuit element 52 of the feed network 12 where the coupled-line quadrature hybrid 36*a* outputs the feed RF signal 48. The feed port 32*a* receives the feed RF signal 48 from the coupled-line quadrature hybrid 36*a* via the circuit element 52 such that the feed port 32*a* is configured with the 0° phase of the feed RF signal 48. The feed RF signal 48 may be referred to herein as "first" feed RF signal. The circuit element 52 may be referred to herein as an "output".

The feed port 32*b* is electrically connected to a circuit element 54 of the feed network 12 where the coupled-line quadrature hybrid 36*a* outputs the feed RF signal 50. The feed port 32*b* receives the feed RF signal 50 from the coupled-line quadrature hybrid 36*a* via the circuit element 54 such that the feed port 32*b* is configured with the 90° phase of the feed RF signal 50. The feed RF signal 50 may be referred to herein as "second" feed RF signal. The circuit element 54 may be referred to herein as an "output".

The coupled-line quadrature hybrid 36*b* is electrically connected to the circuit element 46 for receiving the second intermediate RF signal 42 from the Marchand balun 34. The coupled-line quadrature hybrid 36*b* divides the second intermediate RF signal 42 into two feed RF signals 56 and 58 that have approximately equal power amplitudes and have a phase difference of 90°. Specifically, the feed RF signals 56 and 58 respectively have phases of 180° and 270°, relative to the phase of the input signal 38. The feed port 32*c* is electrically connected to a circuit element 60 of the feed network 12 wherein the coupled-line quadrature hybrid 36*b* outputs the feed RF signal 56. The feed port 32*c* receives the feed RF signal 56 from the coupled-line quadrature hybrid 36*b* via the circuit element 60. The feed port 32*c* thus is configured with the 180° phase of the feed RF signal 56. The feed port 32*d* is electrically connected to a circuit element 62 of the feed network 12 for receiving the feed RF signal 58 from the coupled-line quadrature hybrid 36*b*. The feed port 32*d* thus is configured with the 270° phase of the feed RF signal 58. The feed RF signals 56 and 58 may be referred to herein as "third" and "fourth" feed RF signals, respectively. The circuit elements 60 and 62 may be referred to herein as an "output".

As should be appreciated from the above description and FIG. 1, the Marchand balun 34 and the coupled-line quadrature hybrids 36*a* and 36*b* are electrically arranged relative to the input port 30 and the feed ports 32 such that feed network 12 is configured with feed ports 32 of approximately equal power amplitude and a progressive 90° phase shift of 0°, 90°, 180°, and 270°. The angular direction of the progressive phase shift may be either a right hand direction (e.g., counter-clockwise) or a left hand direction (e.g., clockwise). Whether a right hand direction is considered clockwise or counter-clockwise, and whether a left hand direction is considered clockwise or counter-clockwise, will depend on the orientation of the feed network 12.

Each coupled-line quadrature hybrid 36*a* and 36*b* may have any characteristic impedance, such as, but not limited to, approximately 70.7 Ohms, approximately 50 Ohms, and/or the like. In some embodiments, the coupled-line quadrature hybrid 36*a* and/or 36*b* has a characteristic impedance that is different than a characteristic impedance of the input port 30 and/or the feed ports 32. For example, in the exemplary embodiment of the feed network 12, the coupled-line quadrature hybrids 36*a* and 36*b* each have a characteristic impedance of approximately 70.7 Ohms, while the input port 30 and the feed ports 32 each have a characteristic impedance of approximately 50 Ohms.

Figure 4A:
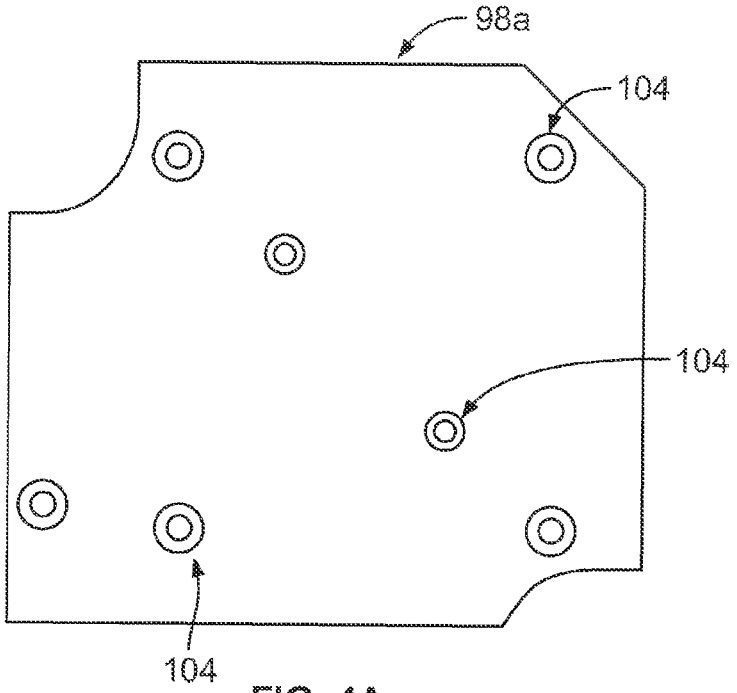
FIGS. 4*a*, 4*b*, 4*c*, 4*d* and 4*e* are plan views of exemplary embodiments of various layers of the printed circuit shown in FIGS. 2 and 3.
Figure 4B:
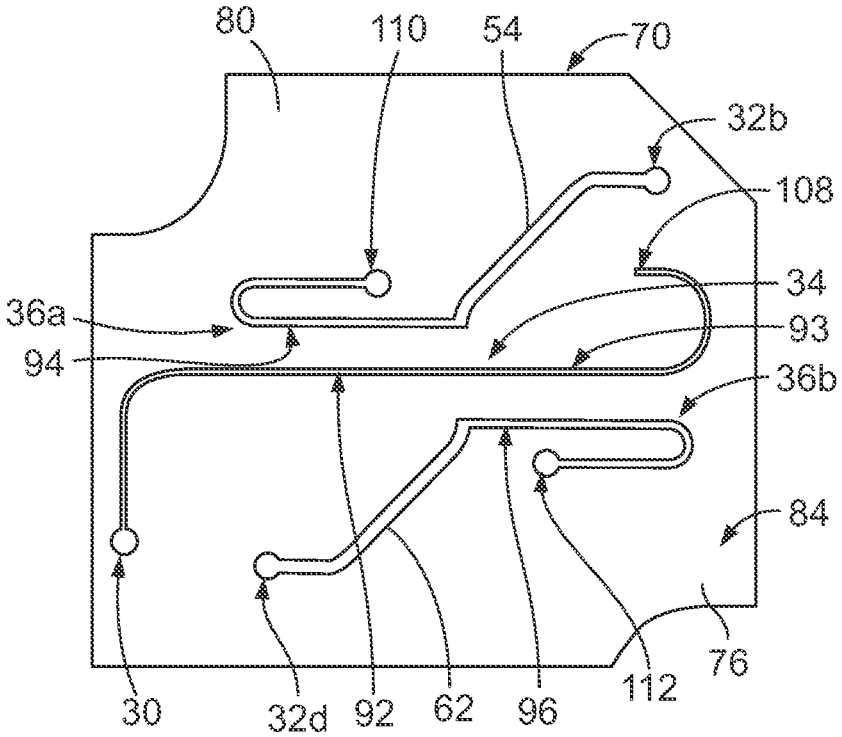
Figure 4C:
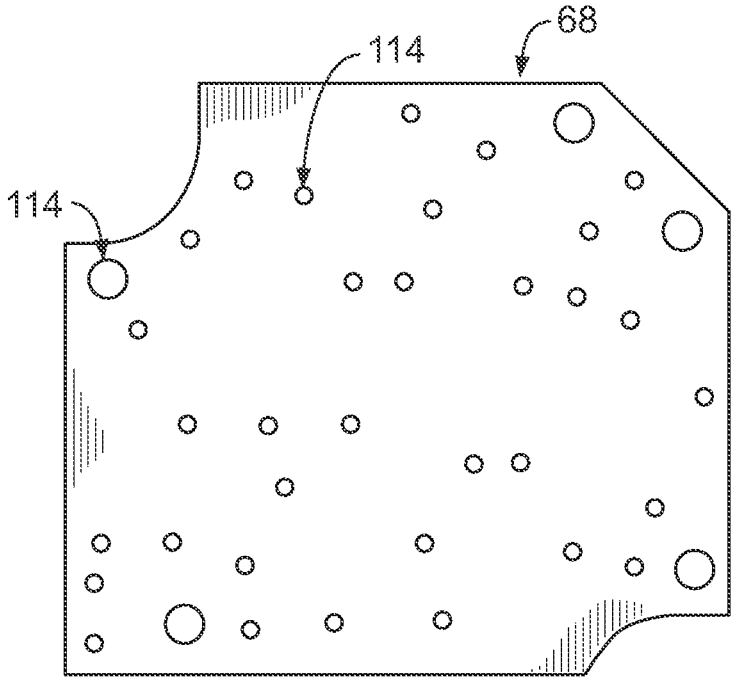
Figure 4D:
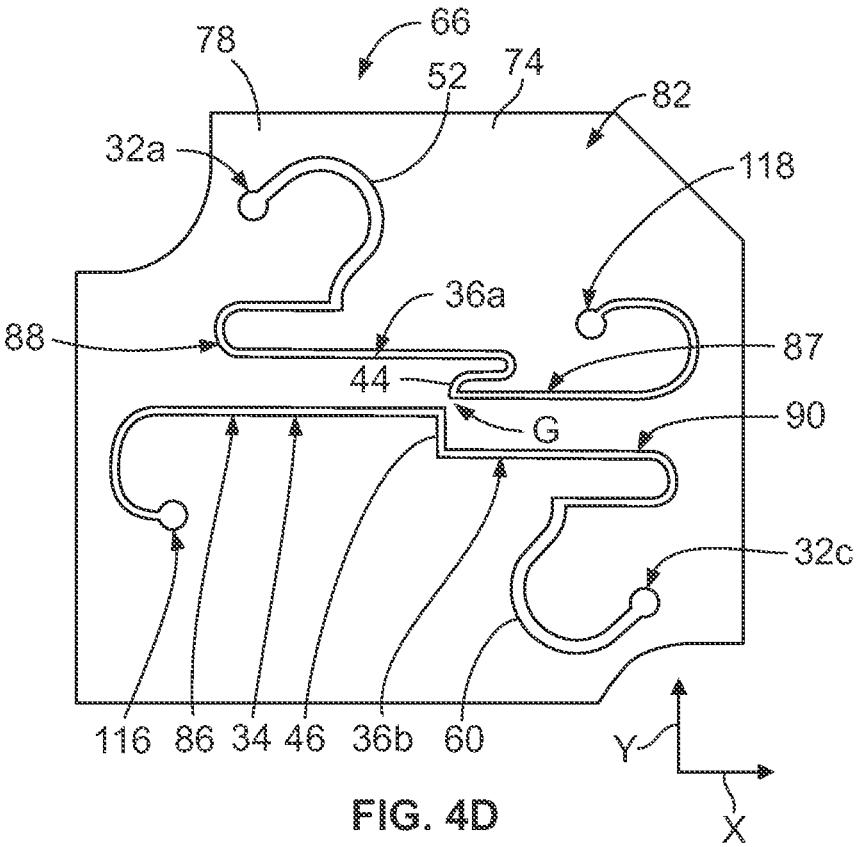

In the exemplary embodiment of the feed network 12, each of the coupled-line quadrature hybrids 36*a* and 36*b* includes only a single transmission line section (e.g., the transmission line sections 150 or 152 shown in FIG. 5), which is formed by two transmission line segments (e.g., the segments 88 and 94 shown in FIGS. 4*d* and 4*b*, respectively, or the segments 90 and 96 shown FIGS. 4*d* and 4*b*, respectively). The single transmission line section of the coupled-line quadrature hybrid 36*a* may be a uniformly-coupled transmission line section or may be a non-uniformly coupled transmission line section. Similarly, the single transmission line section of the coupled-line quadrature hybrid 36*b* may be a uniformly-coupled transmission line section or may be a non-uniformly coupled transmission line section. The two transmission line segments of the transmission line section of the coupled-line quadrature hybrid 36*a* may be offset coupled (i.e., offset from each other in the x direction (along an x axis shown in FIG. 2) and/or y direction (along a y axis shown in FIG. 2)) or may be broadside coupled (i.e., aligned with each other in the x and y directions). Similarly, the two transmission line segments of the transmission line section of the coupled-line quadrature hybrid 36*b* may be offset coupled or may be broadside coupled. The transmission line section of each coupled-line quadrature hybrid 36*a* and 36*b* may have any electrical length. In the exemplary embodiment of the feed network 12, the transmission line section of each of the coupled-line quadrature hybrids 36*a* and 36*b* has an electrical length of one-quarter of a wavelength at the center frequency of operation. Examples of other electrical lengths of the transmission line section of each coupled-line quadrature hybrid 36 include, but are not limited to, three-quarters of a wavelength, five-quarters of a wavelength, and/or the like. In some alternative embodiments, the coupled-line quadrature hybrid 36*a* and/or the coupled-line quadrature hybrid 36*b* includes more than one transmission line section. For example, multiple transmission line sections having electrical lengths of one-quarter of a wavelength may be connected in series to widen the bandwidth of a coupled-line quadrature hybrid 36. In various embodiments, the electrical length of the transmission line section of a uniformly-coupled transmission line section, or the total electrical length of multiple uniformly-coupled transmission line sections, of a coupled-line quadrature hybrid 36 should be some substantially odd integer multiple of a quarter of a wavelength. However, in some other embodiments, the electrical length of the transmission line section of a uniformly-coupled transmission line section, or the total electrical length of multiple uniformly-coupled transmission line sections, of a coupled-line quadrature hybrid 36 is shorter than a quarter of a wavelength. In such embodiments wherein the electrical length is shorter than a quarter of a wavelength, the coupled-line quadrature hybrid 36 operates in a non-ideal condition that may provide acceptable performance in some circumstances. In various embodiments, the electrical length of the transmission line section of a non-uniformly-coupled transmission line section, or the total electrical length of multiple non-uniformly-coupled transmission line sections, of a coupled-line quadrature hybrid 36 will be arbitrary. The transmission line section of each of the coupled line quadrature hybrids 36*a* and 36*b* may be referred to herein as a "quadrature coupler".

Figures 5, 6:
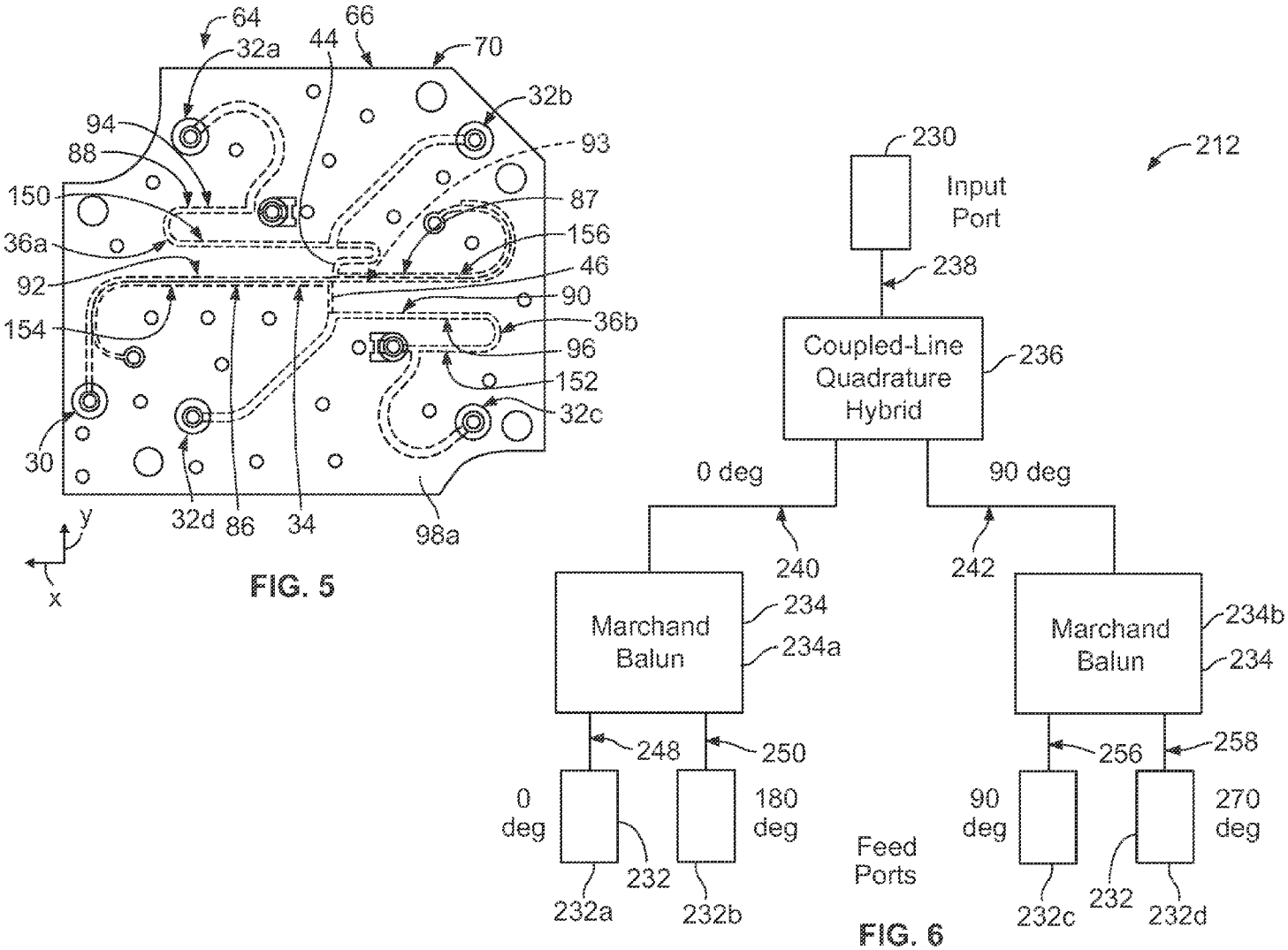
FIG. 5 is a plan view of the printed circuit shown in FIGS. 2, 3, 4*a*, 4*b*, 4*c*, 4*d* and 4*e*.
FIG. 6 is a schematic block diagram of another exemplary embodiment of a feed network.

In the exemplary embodiment of the feed network 12, the Marchand balun 34 includes two transmission line sections (e.g., the transmission line sections 154 or 156 shown in FIG. 5). Each transmission line section of the Marchand balun 34 may be a uniformly-coupled transmission line section or may be a non-uniformly coupled transmission line section. The two transmission line segments of each transmission line section of the Marchand balun 34 may be offset coupled or may be broadside coupled. Each transmission line section of the Marchand balun 34 may have any electrical length. In the exemplary embodiment of the feed network 12, each transmission line section of the Marchand balun 34 has an electrical length of one-quarter of a wavelength at the center frequency of operation. Examples of other electrical lengths of each transmission line section of the Marchand balun 34 include, but are not limited to, three-quarters of a wavelength, five-quarters of a wavelength, and/or the like. The Marchand balun 34 may include more than two transmission line sections in some alternative embodiments. In some embodiments, the Marchand balun 34 includes multiple transmission line sections having electrical lengths of one-quarter of a wavelength that are connected in series to widen the bandwidth of the Marchand balun 34. In various embodiments, the electrical length of the transmission line section of a uniformly-coupled transmission line section, or the total electrical length of multiple uniformly-coupled transmission line sections, of a Marchand balun 34 should be some substantially odd integer multiple of a quarter of a wavelength. However, in some other embodiments, the electrical length of the transmission line section of a uniformly-coupled transmission line section, or the total electrical length of multiple uniformly-coupled transmission line sections, of a Marchand balun 34 is shorter than a quarter of a wavelength. In such embodiments wherein the electrical length is shorter than a quarter of a wavelength, the Marchand balun 34 operates in a non-ideal condition that may provide acceptable performance in some circumstances. In various embodiments, the electrical length of the transmission line section of a non-uniformly-coupled transmission line section, or the total electrical length of multiple non-uniformly-coupled transmission line sections, of a Marchand balun 34 will be arbitrary.

The feed network 12 may operate over any frequency band including, but not limited to, any frequency band between 200 MHz and 60 GHz. By "operate", it is meant that the feed network is capable of combining RF power from the four feed ports 32 into the input port 30, or dividing power from the input port 30 into the four feed ports 32. The feed network 12 may have an increased bandwidth as compared to at least some known feed networks. For example, some known feed networks have a bandwidth of up to only approximately 10%. In some embodiments, the feed network 12 is capable of operating over bandwidths greater than 70%.

The particular RF devices, including the Marchand balun 34 and the coupled-line quadrature hybrids 36, may facilitate providing the feed network 12 with predetermined operating frequencies and/or with a predetermined bandwidth, for example the increased bandwidth relative to at least some known feed networks. Various other parameters of the feed network 12 may be selected to provide the feed network 12 with predetermined operating frequencies and/or with a predetermined bandwidth, for example to provide the increased bandwidth and/or reduced size relative to at least some known feed networks. For example, the electrical length of the coupled-line quadrature hybrid 36*a* and/or 36*b*, the electrical length of the Marchand balun 34, and/or the like may be selected to provide the feed network 12 with predetermined operating frequencies. The number of transmission line sections in the coupled-line quadrature hybrid 36*a*, the number of transmission line sections in the coupled-line quadrature hybrid 36*b*, the number of transmission line sections in the Marchand balun 34, and/or the like may be selected to provide the feed network 12 with a predetermined bandwidth.

The feed network 12 may have any size. For example, the overall x dimension of the feed network 12 (along the x axis shown in FIG. 2) and the overall y dimension of the feed network 12 (along the y axis shown in FIG. 2) may each have any value. Examples of the values of each of the overall x dimension and the overall y dimension of the feed network 12 include, but are not limited to, less than approximately 51 mm (2.0 inches), less than approximately 38.1 mm (1.5 inches), less than approximately 25 mm (1 inch), between approximately 25 mm (1 inch) and approximately 51 mm (2.0 inches), and/or the like. It should be understood that the exemplary dimensions described herein of the feed network 12 are applicable to a feed network 12 having any shape in the x and y dimensions. The feed network 12 may be smaller than at least some known feed networks. For example, at least some known feed networks have x and/or y dimensions that are at least 51 mm (2.0 inches).

Figure 2:
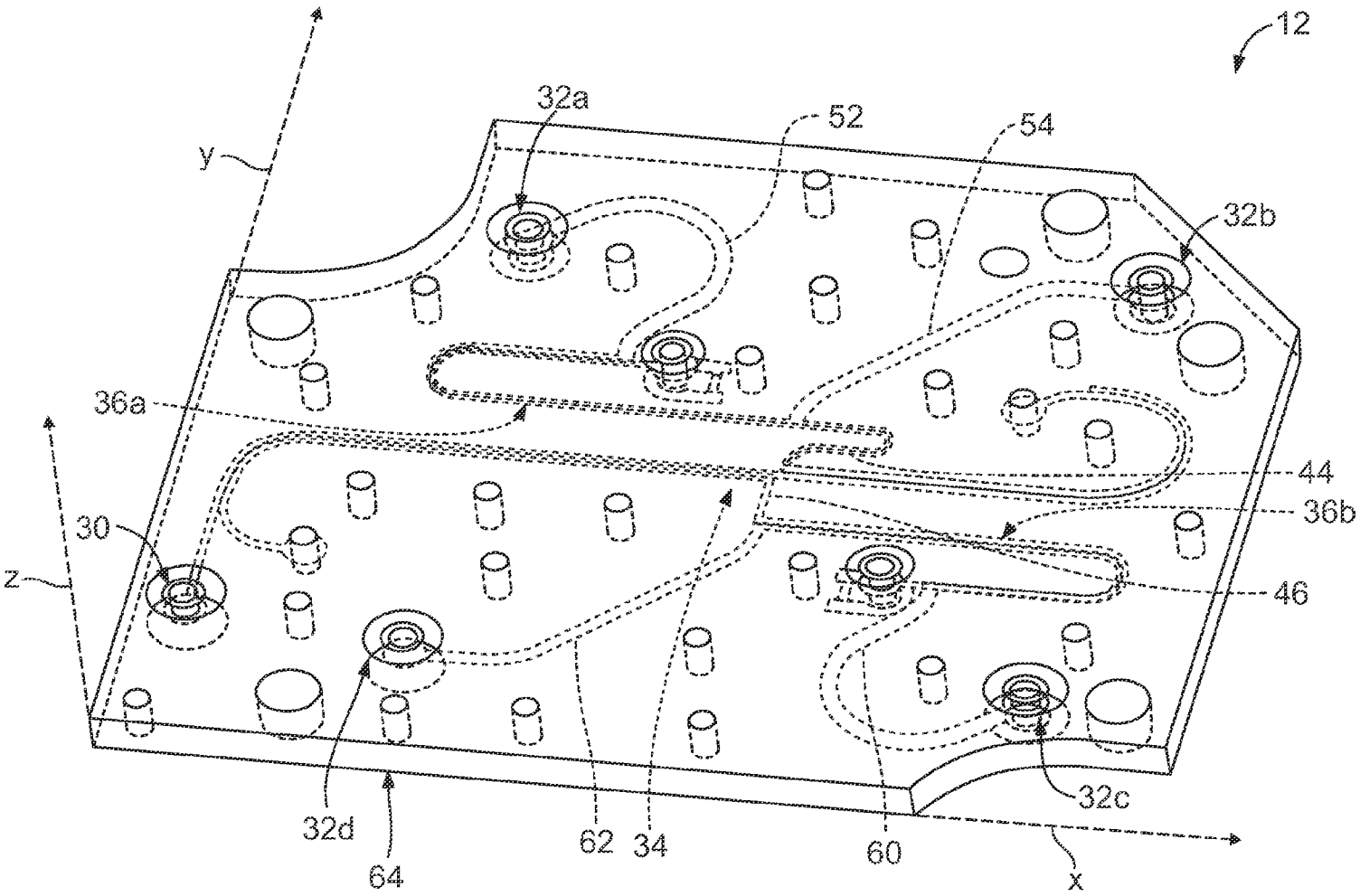
FIG. 2 is a perspective view of an exemplary embodiment of a printed circuit that defines an exemplary embodiment of a suspended-substrate stripline configuration of the feed network shown in FIG. 1.

Various parameters of the feed network 12 may be selected to provide the feed network 12 with a predetermined size, for example with predetermined values for the x dimension (along the x axis shown in FIG. 2) and the y dimension (along the y axis shown in FIG. 2). For example, the use of one or more Marchand baluns 34 and the use of one or more coupled-line quadrature hybrids 36 may be selected to provide the feed network 12 with the predetermined size, for example to provide the reduced size as compared to at least some known feed networks. In one specific example, the use of one or more hybrids 36 that is a quadrature hybrid designed for a characteristic impedance of 70.7 Ohms enables the maximum coupling of the coupled-line quadrature hybrids 36 to exceed that otherwise possible, which accomplishes an approximately 3 dB power division with only a single transmission line section (e.g., having an electrical length of one-quarter of a wavelength). The use of only a single transmission line section according to a specific embodiment, as opposed to the two transmission line sections arranged in tandem in at least some known feed networks, may reduce the size of each of the coupled-line quadrature hybrids 36, and thus the feed network 12 overall.

The Marchand balun 34, the coupled-line quadrature hybrids 36, the input port 30, the feed ports 32, and/or any other components of the feed network 12 may have any electrical arrangement that enable the feed ports 32 of the feed network 12 to have approximately equal amplitude power and a progressive 90° phase shift. For example, FIG. 2 is a perspective view of an exemplary embodiment of a printed circuit 64 that defines an exemplary embodiment of a suspended-substrate stripline configuration of the feed network 12. The printed circuit 64 extends along x, y, and z axes. The printed circuit 64 includes the input port 30, the Marchand balun 34, the coupled-line quadrature hybrids 36*a* and 36*b*, and the feed ports 32*a*, 32*b*, 32*c*, and 32*d*. The printed circuit 64 also includes the circuit elements 44, 46, 52, 54, 60, and 62 as previously described in FIG. 1. The feed network 12 is not limited to the printed circuit 64 or the electrical arrangement shown in FIG. 2. Rather, the printed circuit 64 and the electrical arrangement shown in FIG. 2 are meant as exemplary only. Other configurations, arrangements, and/or the like may be used.

FIG. 3 is a cross-sectional view of the printed circuit 64. The printed circuit 64 includes a circuit element layer 66, a dielectric bonding layer 68, and a circuit element layer 70 arranged in a stack with the bonding layer 68 extending between the circuit element layers 66 and 70. The bonding layer 68 extends a thickness T along a central axis 72 of the printed circuit 64. The circuit element layers 66 and 70 are spaced apart from each other by a gap in the x-z plane (i.e., the plane defined by the x and z axes shown in FIG. 2) that is defined by the thickness T of the bonding layer 68. The circuit element layers 66 and 70 may each be referred to herein as a "first" and/or a "second" layer.

Each of the circuit element layers 66 and 70 includes a respective dielectric substrate 74 and 76 and a respective circuit element sub-layer 78 and 80 extending on a respective side 82 and 84 of the substrate 74 and 76, respectively. As can be seen in FIG. 3, the sides 82 and 84 oppose (i.e., face) each other. The circuit element sub-layer 78 of the circuit element layer 66 includes a transmission line segment 86 and a transmission segment 87 that define portions of the Marchand balun 34. The circuit element sub-layer 78 also includes a transmission line segment 88 and a transmission line segment 90 that define portions of the coupled-line quadrature hybrid 36*a* and the coupled-line quadrature hybrid 36*b*, respectively. Similarly, the circuit element sub-layer 80 of the circuit element layer 70 include a transmission line segment 92 and a transmission line segment 93 that define portions of the Marchand balun 34. The circuit element sub-layer 80 also includes a transmission line segment 94 and a transmission line segment 96 that define portions of the coupled-line quadrature hybrid 36*a* and the coupled-line quadrature hybrid 36*b*, respectively. The transmission line segments 86, 87, 88, and 90 and the transmission line segments 92, 93, 94, and 96 are better illustrated in FIGS. 4*d* and 4*b*, respectively.

The printed circuit 64 includes two or more electrically conductive ground plane layers 98. In the exemplary embodiment, the printed circuit 64 includes two ground plane layers 98*a* and 98*b*. The ground plane layer 98*a* extends on a side 100 of the substrate 74 that is opposite the side 82. The ground plane layer 98*b* extends on a side 102 of the substrate 76 that is opposite the side 84. Although two ground plane layers are shown, the printed circuit 64 may include any number of ground plane layers 98, each of which may be an external layer (as is shown in FIG. 3) or an internal layer of the printed circuit 64. Moreover, although shown and described herein as having four layers, the printed circuit 64 may include any number of layers. For example, the printed circuit 64 may include any number of bonding layers 68 and/or more than two dielectric substrates 74 and 76.

Figure 4E:
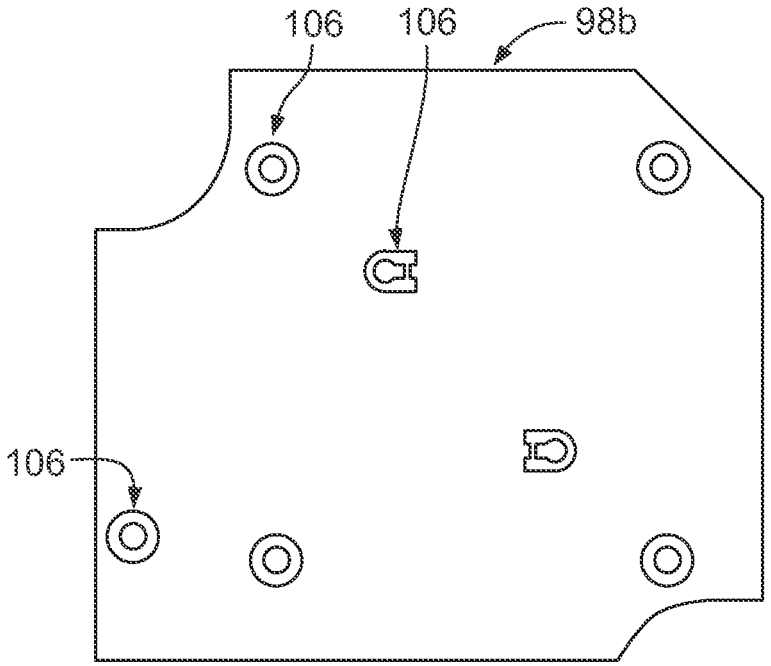

FIGS. 4*a*, 4*b*, 4*c*, 4*d* and 4*e* are plan views of the various layers of the printed circuit 64. Specifically, FIGS. 4*a* and 4*e* illustrate the ground plane layers 98*a* and 98*b*, respectively. The ground plane layers 98*a* and 98*b* may each include one or more openings, vias, and/or other structures 104 and 106, respectively, that enable electrical and/or other connections to be made to the printed circuit 64, for example at the input port 30, the feed ports 32, and/or the like. The ground plane layers 98*a* and 98*b* and the circuit element layers 70 and 66 are each electrically conductive and may each be fabricated from any electrically conductive material containing or comprising metals, such as, but not limited to, copper, gold, silver, aluminum, tin, and/or the like.

FIG. 4*b* illustrates the circuit element layer 70. The side 84 of the substrate 76 having the circuit element layer 70 is visible in FIG. 4*b*. The circuit element sub-layer 80 extends on the side 84 and includes the transmission line segment 92, the transmission line segment 93, the transmission line segment 94, and the transmission line segment 96. As described above, the segments 92 and 93 define portions of the Marchand balun 34 and the segments 94 and 96 define portions of the coupled-line quadrature hybrid 36*a* and the coupled-line quadrature hybrid 36*b*, respectively. The circuit element sub-layer 80 also includes the input port 30, the feed ports 32*b* and 32*d*, the circuit element 54, and the circuit element 62.

The transmission line segment 92 extends from the input port 30 to the transmission line segment 93, which extends from the transmission line segment 92 to an open end 108. The transmission line segment 94 extends from a resistor 110 of the coupled-line quadrature hybrid 36*a* to the circuit element 54, which extends from the transmission line segment 94 to the feed port 32*b*. The transmission line segment 96 extends from a resistor 112 of the coupled-line quadrature hybrid 36*b* to the circuit element 62. The circuit element 62 extends from the transmission line segment 96 to the feed port 32*d*. As described above, the coupled-line quadrature hybrids 36*a* and/or 36*b* may have characteristic impedances that are different than the characteristic impedance of the input port 30 and/or the feed ports 32. The resistors 110 and 112 may each have any value of resistance. For example, in the exemplary embodiment of the feed network 12, the resistance value of the resistors 110 and 112 is selected as approximately 50 Ohms.

FIG. 4*c* illustrates the bonding layer 68. The bonding layer 68 may each include one or more openings, vias, and/or other structures 114 that enable electrical and/or other connections to be made to the printed circuit 64, between various elements of the circuit elements layers 66 and 70, and/or between the ground plane layers 98*a* and 98*b*. The bonding layer 68 may have any dielectric constant. Examples of suitable materials for the bonding layer 68 include, but are not limited to, ceramic, rubber, fluoropolymer, composite material, fiberglass, plastic, and/or the like.

FIG. 4*d* illustrates the circuit element layer 66. The side 82 of the substrate 74 having the circuit element layer 66 is visible in FIG. 4*d*. The circuit element sub-layer 78 extends on the side 82 and includes the transmission line segment 86, the transmission line segment 87, the transmission line segment 88, and the transmission line segment 90. As described above, the segments 86 and 87 define portions of the Marchand balun 34, while the segments 88 and 90 define portions of the coupled-line quadrature hybrid 36*a* and the coupled-line quadrature hybrid 36*b*, respectively. The circuit element sub-layer 78 includes the feed ports 32*a* and 32*c*, the circuit element 46, the circuit element 44, the circuit element 52, and the circuit element 60.

The transmission line segment 86 extends from an electrical ground short 116 to the circuit element 46. The transmission line segment 90 extends from the circuit element 46 to the circuit element 60, which extends from the transmission line segment 90 to the feed port 32*c*. The transmission line segment 87 extends from an electrical ground short 118 to the circuit element 44. The transmission line segment 88 extends from the circuit element 44 to the circuit element 52, which extends from the transmission line segment 88 to the feed port 32*a*. As can be seen in FIG. 4*d*, the transmission line segments 86 and 87 are separated by a gap G in the x-y plane, with the circuit elements 44 and 46 provided on opposite sides of the gap G. The gap G is a segment of transmission line (defined by the intersection of transmission line segments 92 and 93 shown in FIG. 4*b*) that extends between the transmission line segments 86 and 87, and thus between the first and second transmission line sections 154 and 156 (FIG. 5) of the Marchand balun 34.

FIG. 5 is a plan view of the printed circuit 64 illustrating an overlay of the circuit element layers 66 and 70. Various components of the circuit element layers 66 and 70, including the input port 30, the feed ports 32*a*-32*d*, and the circuit elements 44 and 46, are visible through the ground plane layer 98*a*, the substrate 74 (FIGS. 3 and 4*d*), and the bonding layer 68 (FIGS. 3 and 4*c*) to illustrate an overlay of the various components of the circuit element layers 66 and 70.

The transmission line segments 86 and 92 of the circuit element layers 66 and 70, respectively, define a first transmission line section 154 of the Marchand balun 34. In the exemplary embodiment of the printed circuit 64, the transmission line segments 86 and 92 are offset coupled (i.e., are offset from each other in the x direction along the x axis and/or the y direction along the y axis). Alternatively, the transmission line segments 86 and 92 are broadside coupled (i.e., aligned with each other in the x and y directions).

The transmission line segments 87 and 93 of the circuit element layers 66 and 70, respectively, define the second transmission line section 156 of the Marchand balun 34. In the exemplary embodiment of the printed circuit 64, the transmission line segments 87 and 93 are offset coupled. Alternatively, the transmission line segments 87 and 93 are broadside coupled.

The transmission line segments 88 and 94 of the circuit element layers 66 and 70, respectively, define the single transmission line section 150 of the coupled-line quadrature hybrid 36*a*. In the exemplary embodiment of the printed circuit 64, the transmission line segments 88 and 94 are broadside coupled. But, the transmission line segments 88 and 94 may alternatively be offset coupled.

The coupler segments 90 and 96 of the circuit element layers 66 and 70, respectively, define the single transmission line section 152 of the coupled-line quadrature hybrid 36*b*. In the exemplary embodiment of the printed circuit 64, the transmission line segments 90 and 96 are broadside coupled. But, the transmission line segments 90 and 96 may be offset coupled in some alternative embodiments.

The feed network 12 is not limited to including a single Marchand balun 34 and two coupled-line quadrature hybrids 36. For example, FIG. 6 is a schematic block diagram of another exemplary embodiment of a feed network 212. The feed network 212 includes at least three RF devices constructed in a suspended-substrate stripline configuration. In the exemplary embodiment of the feed network 12, the three RF devices include a single coupled-line quadrature hybrid 236 and two Marchand baluns 234*a* and 234*b*. Specifically, the feed network 212 includes an input port 230, four feed ports 232, the coupled-line quadrature hybrid 236, and the two Marchand baluns 234. The four exemplary feed ports 232 are labeled as feed ports 232*a*, 232*b*, 232*c*, and 232*d*. The input port 230 may be referred to herein as a "sum port". The Marchand baluns 234*a* and 234*b* may each be referred to herein as a "first" and/or a "second" balun. The coupled-line quadrature hybrid 236 may be referred to herein as a "first" quadrature hybrid. Each of the feed ports 232*a*-232*d* may be referred to respectively herein as a "first", a "second", a "third", and/or a "fourth" feed port.

The coupled-line quadrature hybrid 236 and the Marchand baluns 234*a* and 234*b* are operatively connected between the input port 230 and the feed ports 232 for feeding RF energy between the input port 230 and the feed ports 232. The coupled-line quadrature hybrid 236 is configured to divide an RF signal into two RF signals that have approximately equal power amplitudes and a phase difference of 90°. Each of the Marchand baluns 234 is configured to divide an RF signal into two RF signals with approximately equal power amplitudes and a phase difference of 180°.

The Marchand baluns 234 and the coupled-line quadrature hybrid 236 are electrically arranged relative to the input port 230 and the feed ports 232 such that the four feed ports 232 are configured with approximately equal power amplitude and a progressive 90° phase shift. For example, in the exemplary embodiment of the feed network 212, the coupled-line quadrature hybrid 236 is electrically connected between the input port 230 and the Marchand baluns 234, while the Marchand baluns 234 are electrically connected between the coupled-line quadrature hybrid 234 and the feed ports 232. Specifically, and as shown in FIG. 6, the coupled-line quadrature hybrid 236 is electrically connected between the input port 230 and each of the Marchand baluns 234*a* and 234*b*. The Marchand balun 234*a* is electrically connected between the coupled-line quadrature hybrid 236 and the feed ports 232*a* and 232*b*. The Marchand balun 234*b* is electrically connected between the coupled-line quadrature hybrid 236 and the feed ports 232*c* and 232*d*.

During operation of the feed network 212, the coupled-line quadrature hybrid 236 receives an input RF signal 238 from the input port 230. The coupled-line quadrature hybrid 236 divides the input RF signal 238 into two intermediate RF signals 240 and 242 that have approximately equal amplitudes and a phase difference of 90°. The intermediate RF signals 240 and 242 have respective phases of 0° and 90°, relative to the phase of the input RF signal 238. The intermediate RF signal 240 may be referred to herein as a "first" intermediate RF signal, while the intermediate RF signal 242 may be referred to herein as a "second" intermediate RF signal.

The Marchand balun 234*a* receives the intermediate RF signal 240 from the coupled-line quadrature hybrid 236 and divides the intermediate RF signal 240 into two feed RF signals 248 and 250 that have approximately equal power amplitudes and a phase difference of 180°. Specifically, the feed RF signals 248 and 250 have phases of 0° and 180°, respectively. The feed port 232*a* receives the feed RF signal 248 from the Marchand balun 234*a* such that the feed port 232*a* is configured with the 0° phase of the feed RF signal 248. The feed RF signal 248 may be referred to herein as "first" feed RF signal.

The feed port 232*b* receives the feed RF signal 250 from the Marchand balun 234*a* such that the feed port 232*b* is configured with the 180° phase of the feed RF signal 250. The feed RF signal 250 may be referred to herein as "second" feed RF signal.

The Marchand balun 234*b* receives the intermediate RF signal 242 from the coupled-line quadrature hybrid 236. The Marchand balun 234*b* divides the intermediate RF signal 242 into two feed RF signals 256 and 258 that have approximately equal power amplitudes and a phase difference of 180°. Specifically, the feed RF signals 256 and 258 have respective phases of 90° and 270°. The feed port 232*c* receives the feed RF signal 256 from the Marchand balun 234*b*. The feed port 232*c* is thus configured with the 90° phase of the feed RF signal 256. The feed port 232*d* receives the feed RF signal 258 from the Marchand balun 234*b*. The feed port 232*d* is thus configured with the 270° phase of the feed RF signal 258. The feed RF signals 256 and 258 may be referred to herein as "third" and "fourth" feed RF signals, respectively.

As should be appreciated from the above description and FIG. 6, the coupled-line quadrature hybrid 236 and the Marchand baluns 234*a* and 234*b* are electrically arranged relative to the input port 230 and the feed ports 232 such that feed network 212 is configured with approximately equal power amplitude and a progressive 90° phase shift of 0°, 90°, 180°, and 270°. The angular direction of the progressive phase shift may either a right hand direction (i.e., counter-clockwise) and/or a left hand direction (i.e., clockwise).

The coupled-line quadrature hybrid 236 may have any characteristic impedance, such as, but not limited to, approximately 70.7 Ohms, approximately 50 Ohms, and/or the like. In some embodiments, the coupled-line quadrature hybrid 236 has characteristic impedance that is different than a characteristic impedance of the input port 230 and/or the feed ports 232. For example, in the exemplary embodiment of the feed network 12, the coupled-line quadrature hybrid 236 has a characteristic impedance of approximately 70.7 Ohms, while the input port 230 and the feed ports 232 each have a characteristic impedance of approximately 50 Ohms.

In the exemplary embodiment of the feed network 212, the coupled-line quadrature hybrid 236 includes only a single transmission line section. The single transmission line section of the coupled-line quadrature hybrid 236 may be a uniformly-coupled transmission line section or may be a non-uniformly coupled transmission line section. The two transmission line segments of the transmission line section of the coupled-line quadrature hybrid 236 may be offset coupled or may be broadside coupled. The transmission line section of the coupled-line quadrature hybrid 236 may have any electrical length. In the exemplary embodiment of the feed network 212, the transmission line section of the coupled-line quadrature hybrid 236 has an electrical length of one-quarter of a wavelength at the center frequency of operation. Examples of other electrical lengths of the transmission line section of the coupled-line quadrature hybrid 236 include, but are not limited to, three-quarters of a wavelength, five-quarters of a wavelength, and/or the like. In some alternative embodiments, the coupled-line quadrature hybrid 236 includes more than one transmission line section. For example, multiple transmission line sections having electrical lengths of one-quarter of a wavelength may be connected in series to widen the bandwidth of the coupled-line quadrature hybrid 236. The transmission line section of the coupled line quadrature hybrid 236 may be referred to herein as a "quadrature coupler".

In the exemplary embodiment of the feed network 212, each Marchand balun 234*a* and 234*b* includes two transmission line sections. Each transmission line section of each Marchand balun 234 may be a uniformly-coupled transmission line section or may be a non-uniformly coupled transmission line section. The two transmission line segments of each transmission line section of each Marchand balun 234 may be offset coupled or may be broadside coupled. Each transmission line section of each Marchand balun 234 may have any electrical length. In the exemplary embodiment of the feed network 212, each transmission line section of each Marchand balun 234 has an electrical length of one-quarter of a wavelength at the center frequency of operation. Examples of other electrical lengths of each transmission line section of each Marchand balun 234 include, but are not limited to, three-quarters of a wavelength, five-quarters of a wavelength, and/or the like. One or both of the Marchand baluns 234 may include more than two transmission line sections in some alternative embodiments. In some embodiments, one or both of the Marchand baluns 234 includes multiple transmission line sections having electrical lengths of one-quarter of a wavelength that are connected in series to widen the bandwidth of the Marchand balun 234.

The embodiments described and/or illustrated herein may provide a five-port microwave device with one sum port and four feed ports, wherein the feed ports have equal amplitude power and a progressive 90° phase shift.

The embodiments described and/or illustrated herein may provide a feed network that operates over a wider frequency band than at least some known feed networks. The embodiments described and/or illustrated herein may provide a feed network having a bandwidth that enables an associated antenna to communicate with one or more devices.

The embodiments described and/or illustrated herein may provide a feed network that is smaller than at least some known feed networks. The embodiments described and/or illustrated herein may provide an array that is capable of including more feed networks, and thus more antennas, than at least some known arrays of antennas.

The embodiments described and/or illustrated herein may provide a feed network that is less expensive to fabricate than at least some known feed networks.

In one embodiment, a feed network is comprised of a total of three devices, including one or two coupled-line quadrature hybrids and one or two Marchand baluns. Each coupled-line quadrature hybrid consists of a single quadrature coupler providing two outputs with approximately equal amplitude power and a phase difference of 90°, as opposed to two or more couplers in tandem. Each Marchand balun consists of two offset-coupled transmission line sections separated by a gap, from opposite sides of which gap two output ports are connected, the two output ports having approximately equal amplitude power and a phase difference of 180°. The three devices are built in a suspended-substrate stripline configuration, providing a five-port microwave device with one sum port and four feed ports. The feed ports have equal amplitude power and a progressive 90° phase shift.

Optionally, each quadrature coupler consists of at least one uniformly-coupled transmission line section, each with an electrical length of one-quarter of a wavelength at the center frequency of operation, providing outputs with approximately equal amplitude power and a phase difference of 90°. Optionally, each quadrature coupler consists of a non-uniformly coupled transmission line section, providing two outputs with approximately equal amplitude power and a phase difference of 90°.

Optionally, each Marchand balun consists of at least two uniformly-coupled transmission line sections, each with an electrical length of one-quarter of a wavelength at the center frequency of operation, providing outputs with approximately equal amplitude power and a phase difference of 180°. Optionally, each Marchand balun consists of a non-uniformly coupled transmission line section, providing outputs with approximately equal amplitude power and a phase difference of 180°.

In some embodiments, the at least one Marchand balun comprises a first balun, the at least one coupled-line quadrature hybrid comprises first and second quadrature hybrids, and the four feed ports comprise first, second, third, and fourth feed ports. The first balun is electrically connected between the input port and the first and second quadrature hybrids and is configured to divide an input RF signal into first and second intermediate RF signals with approximately equal power amplitudes and a phase difference of 180°. The first quadrature hybrid is electrically connected between the first balun and the first and second feed ports and is configured to divide the first intermediate RF signal into first and second feed RF signals having phases of 0° and 90°, respectively. The second quadrature hybrid is electrically connected between the first balun and the third and fourth feed ports and is configured to divide the second intermediate RF signal into third and fourth feed RF signals having phases of 180° and 270°, respectively.

In some embodiments, the at least one Marchand balun comprises first and second baluns, the at least coupled-line quadrature hybrid comprises a first quadrature hybrid, and the four feed ports comprise first, second, third, and fourth feed ports. The first quadrature hybrid is electrically connected between the input port and the first and second baluns and is configured to divide an input RF signal into first and second intermediate RF signals with approximately equal power amplitudes and a phase difference of 90°. The first balun is electrically connected between the first quadrature hybrid and the first and third feed ports and is configured to divide the first intermediate RF signal into first and third feed RF signals having phases of 0° and 180°, respectively. The second balun is electrically connected between the first quadrature hybrid and the second and fourth feed ports and is configured to divide the second intermediate RF signal into second and fourth feed RF signals having phases of 90° and 270°, respectively.

In some embodiments, a four-layer printed circuit board stackup is used, with the upper substrate core providing two conductive layers for circuitry, the lower substrate core providing another two conductive layers for circuitry, and the at least one bonding film between the cores providing physical separation between the lower side of the upper substrate core and the upper side of the lower substrate core.

Optionally, the feed network is configured to operate over a bandwidth of at least approximately 10 percent. The feed network optionally has a width of less than approximately 2.0 inches (50.8 mm).

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A feed network comprising:

three radio frequency (RF) devices constructed on a printed circuit that provides a five-port microwave device having a sum port and four feed ports, the printed circuit including a first circuit element layer, a dielectric bonding layer, and a second circuit element layer arranged in a stack with the dielectric bonding layer extending between the first and second circuit element layers, the first and second circuit element layers each including a respective conductive circuit element sub-layer, a respective conductive ground plane layer, and a respective dielectric substrate between the corresponding circuit element sub-layer and the corresponding ground plane layer, the three RF devices including at least one coupled-line quadrature hybrid and at least one Marchand balun, wherein respective portions of the at least one coupled-line quadrature hybrid and the at least one Marchand balun being defined by each of the circuit element sub-layer of the first circuit element layer and the circuit element sub-layer of the second circuit element layer;

wherein each of the at least one coupled-line quadrature hybrid has only a respective single transmission line section providing two corresponding outputs with approximately equal amplitude power and a phase difference of 90°;

wherein each of the at least one Marchand balun includes two offset-coupled transmission line sections separated by a gap and two outputs on opposite sides of the gap, the two outputs having approximately equal amplitude power and a phase difference of 180°; and wherein the three RF devices are electrically arranged relative to the sum port and the four feed ports such that the feed ports have equal amplitude power and a progressive 90° phase shift.

2. The feed network of claim 1, wherein the at least one coupled-line quadrature hybrid is a single coupled-line quadrature hybrid and the at least one Marchand balun is two Marchand baluns.

3. The feed network of claim 1, wherein the at least one Marchand balun is a single Marchand balun and the at least one coupled-line quadrature hybrid is two coupled-line quadrature hybrids.

4. The feed network of claim 1, wherein the four feed ports comprise first, second, third, and fourth feed ports, the at least one Marchand balun is a single Marchand balun, and the at least one coupled-line quadrature hybrid comprises first and second coupled-line quadrature hybrids, the Marchand balun being electrically connected between the sum port and the first and second coupled-line quadrature hybrids and being configured to divide an input RF signal into first and second intermediate RF signals with approximately equal power amplitudes and a phase difference of 180°, the first coupled-line quadrature hybrid being electrically connected between the Marchand balun and the first and second feed ports and being configured to divide the first intermediate RF signal into first and second feed RF signals having phases of 0° and 90°, respectively, the second coupled-line quadrature hybrid being electrically connected between the Marchand balun and the third and fourth feed ports and being configured to divide the second intermediate RF signal into third and fourth feed RF signals having phases of 180° and 270°, respectively.

5. The feed network of claim 4, wherein the circuit element sub-layer of the first circuit element layer includes the first and third feed ports, and the circuit element sub-layer of the second circuit element layer includes the second and fourth feed ports.

6. The feed network of claim 1, wherein the transmission line section of the at least one coupled-line quadrature hybrid is a uniformly-coupled transmission line section.

7. The feed network of claim 1, wherein the transmission line section of the at least one coupled-line quadrature hybrid is a non-uniformly coupled transmission line section.

8. The feed network of claim 1, wherein each of the transmission line sections of the at least one Marchand balun is a respective uniformly-coupled transmission line section.

9. The feed network of claim 1, wherein each of the transmission line sections of the at least one Marchand balun is a respective non-uniformly coupled transmission line section.

10. The feed network of claim 1, wherein the transmission line section of the at least one coupled-line quadrature hybrid includes two transmission line segments that are offset coupled, one of the two transmission line segments being defined by the circuit element sub-layer of the first circuit element layer, the other of the two transmission line segments being defined by the circuit element sub-layer of the second circuit element layer.

11. The feed network of claim 1, wherein the transmission line section of the at least one coupled-line quadrature hybrid includes two transmission line segments that are broadside coupled.

12. The feed network of claim 1, wherein the at least one coupled-line quadrature hybrid has a characteristic impedance that is different than a characteristic impedance of at least one of the sum port and the four feed ports.

13. The feed network of claim 1, wherein the transmission line section of the at least one coupled-line quadrature hybrid has an electrical length of one-quarter of a wavelength at the center frequency of operation.

14. The feed network of claim 1, wherein each transmission line section of the at least one Marchand balun has an electrical length of one-quarter of a wavelength at the center frequency of operation.

15. The feed network of claim 1, wherein the four feed ports comprise first, second, third, and fourth feed ports, the at least one coupled-line quadrature hybrid is a single coupled-line quadrature hybrid, and the at least one Marchand balun comprises first and second Marchand baluns, the coupled-line quadrature hybrid being electrically connected between the input port and the first and second Marchand baluns and being configured to divide an input RF signal into first and second intermediate RF signals with approximately equal power amplitudes and a phase difference of 90°, the first Marchand balun being electrically connected between the coupled-line quadrature hybrid and the first and third feed ports and being configured to divide the first intermediate RF signal into first and third feed RF signals having phases of 0° and 180°, respectively, the second Marchand balun being electrically connected between the coupled-line quadrature hybrid and the second and fourth feed ports and being configured to divide the second intermediate RF signal into second and fourth feed RF signals having phases of 90° and 270°, respectively.

16. The feed network of claim 1, wherein the feed network has a width of less than approximately 51 mm or 2.0 inches.

17. A feed network comprising:

three radio frequency (RF) devices constructed on a printed circuit that provides a five-port microwave device having a sum port and four feed ports, the printed circuit including a first circuit element layer, a dielectric bonding layer, and a second circuit element layer arranged in a stack with the dielectric bonding layer extending between the first and second circuit element layers, the first and second circuit element layers each including a respective conductive circuit element sub-layer, a respective conductive ground plane layer, and a respective dielectric substrate between the corresponding circuit element sub-layer and the corresponding ground plane layer, the three RF devices comprising:

first and second coupled-line quadrature hybrids each having only a respective single transmission line section that provides two corresponding outputs with approximately equal amplitude power and a phase difference of 90°; and a Marchand balun having two offset-coupled transmission line sections separated by a gap and two outputs on opposite sides of the gap, the two outputs having approximately equal amplitude power and a phase difference of 180°, wherein the Marchand balun and the first and second coupled-line quadrature hybrids are electrically arranged relative to the sum port and the four feed ports such that the four feed ports have equal amplitude power and a progressive 90° phase shift, wherein respective portions of the first and second coupled-line quadrature hybrids and the Marchand balun are defined by each of the circuit element sub-layer of the first circuit element layer and the circuit element sub-layer of the second circuit element layer.

18. The feed network of claim 17, wherein the four feed ports comprise first, second, third, and fourth feed ports, the Marchand balun being electrically connected between the sum port and the first and second coupled-line quadrature hybrids, the Marchand balun being configured to divide an input RF signal into first and second intermediate RF signals with approximately equal power amplitudes and a phase difference of 180°, the first coupled-line quadrature hybrid being electrically connected between the Marchand balun and the first and second feed ports, the first coupled-line quadrature hybrid being configured to divide the first intermediate RF signal into first and second feed RF signals having phases of 0° and 90°, respectively, the second coupled-line quadrature hybrid being electrically connected between the Marchand balun and the third and fourth feed ports, the second coupled-line quadrature hybrid being configured to divide the second intermediate RF signal into third and fourth feed RF signals having phases of 180° and 270°, respectively.

19. A feed network comprising:

three radio frequency (RF) devices constructed on a printed circuit that provides a five-port microwave device having a sum port and four feed ports, the printed circuit including a first circuit element layer, a dielectric bonding layer, and a second circuit element layer arranged in a stack with the dielectric bonding layer extending between the first and second circuit element layers, the first and second circuit element layers each including a respective conductive circuit element sub-layer, a respective conductive ground plane layer, and a respective dielectric substrate between the corresponding circuit element sub-layer and the corresponding ground plane layer, the three RF devices comprising:

first and second Marchand baluns each having two offset-coupled transmission line sections separated by a gap and two outputs on opposite sides of the gap, the two outputs having approximately equal amplitude power and a phase difference of 180°, and a coupled-line quadrature hybrid having only a single transmission line section that provides two outputs with approximately equal amplitude power and a phase difference of 90°, wherein the coupled-line quadrature hybrid and the first and second Marchand baluns are electrically arranged relative to the sum port and the four feed ports such that the feed ports have equal amplitude power and a progressive 90° phase shift among the four feed ports, wherein respective portions of the coupled-line quadrature hybrid and the first and second Marchand baluns are defined by each of the circuit element sub-layer of the first circuit element layer and the circuit element sub-layer of the second circuit element layer.

20. The feed network of claim 19, wherein the four feed ports comprise first, second, third, and fourth feed ports, the coupled-line quadrature hybrid being electrically connected between the sum port and the first and second Marchand baluns, the coupled-line quadrature hybrid being configured to divide an input RF signal into first and second intermediate RF signals with approximately equal power amplitudes and a phase difference of 90°, the first Marchand balun being electrically connected between the coupled-line quadrature hybrid and the first and third feed ports, the first Marchand balun being configured to divide the first intermediate RF signal into first and third feed RF signals having phases of 0° and 180°, respectively, the second Marchand balun being electrically connected between the coupled-line quadrature hybrid and the second and fourth feed ports, the second Marchand balun being configured to divide the second intermediate RF signal into second and fourth feed RF signals having phases of 90° and 270°, respectively.

* * * * *